United States Patent [19]

Glasheen

[11] 4,325,552

[45] Apr. 20, 1982

[54] MANIPULATIVE TOY

[76] Inventor: Michael O. Glasheen, Lot 6, Lower Colo Rd., Lower Portland, New South Wales, 2756, Australia

[21] Appl. No.: 135,336

[22] Filed: Mar. 31, 1980

[51] Int. Cl.[3] ..... A63F 9/08; G09B 23/04

[52] U.S. Cl. ..... 273/153 P; 434/211

[58] Field of Search ..... 35/34, 18 A, 30, 72; 273/157 R, 153 R, 153 P; 46/29, 31; 434/211, 213, 403

[56] References Cited

U.S. PATENT DOCUMENTS

| | | | |
|---|---|---|---|
| 2,942,356 | 6/1960 | Weintraub | 35/18 A |
| 3,091,870 | 6/1963 | Sangster | 35/34 X |
| 3,837,652 | 9/1974 | Kuwagaki et al. | 273/157 R |
| 3,945,645 | 3/1976 | Roberts | 273/157 R |
| 4,060,247 | 11/1977 | Kobres | 273/157 R |

FOREIGN PATENT DOCUMENTS

| | | | |
|---|---|---|---|
| 597762 | 2/1948 | United Kingdom | 35/18 A |

*Primary Examiner*—William H. Grieb

*Attorney, Agent, or Firm*—DeLio and Montgomery

[57] ABSTRACT

A manipulative toy comprising a number of spheres serially attached in a closed loop or open chain, each sphere being attached to the next at a fixed point on its surface by a connector which allows relative rotation of adjacent spheres about a common axis through their centres.

4 Claims, 6 Drawing Figures

MANIPULATIVE TOY

BACKGROUND OF THE INVENTION

This invention relates to manipulative toys the purpose of which is to combine entertainment and instruction in geometrical and structural relationships.

Many such toys are known in the prior art which consist of various combinations of basic geometrical units such as cubes, balls and other objects, with connecting devices such as rods to enable the construction of various geometrical or functional arrays.

SUMMARY OF THE INVENTION

The present invention employs a plurality of balls or spheres to enable the exploration of the basic geometrical and structural properties of closest packed spheres, and is based on the discovery that by providing a plurality of spheres interconnected in a manner characterized below, infant awareness of such properties as the triangularity of closest packed spheres, the foldability of two dimensional nets of spheres into regular and irregular three dimensional forms may be induced, and structural puzzles may be made which combine such education with entertainment and the encouragement of logical thought.

In the present invention a plurality of spheres are interconnected to form an open chain or a closed loop, the connection between any two spheres being at a fixed point at the surface of each sphere and maintaining the surfaces of the spheres substantially in contact at the point of connection, while allowing relative rotation between two connected spheres about a common axis through their centres.

The invention will be further described by way of example only with reference to embodiments thereof illustrated in the accompanying drawings.

DETAILED DESCRIPTION OF THE DRAWINGS

Figure 1:
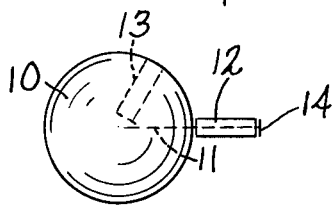
FIG. 1 is a cross-sectional view of a sphere showing connecting devices for the purpose of the present invention.

In FIG. 1 there is illustrated in cross-section a sphere in the form of a wooden ball 10, and an arrangement for rotatably connecting the ball 10 to a similar ball, this arrangement comprising a pin 11 embedded on a radius within the ball 10, the pin 11 carrying on its length outside the ball a cylindrical socket 12, the internal diameter of which provides a close sliding fit for the pin 11.

The socket 12 is housed in the connected ball by its reception within a cylindrical cavity 13, this cavity again being radially disposed in the ball. Separation of connected balls is prevented by a head 14 on the outer end of the pin 11.

A pair of connected balls is assembled by placing a socket 12 over a pin 11 and the latter is fixed within a hole drilled radially into the first of the balls to be connected. The pin is inserted to such a depth that the adjacent end of the socket 12 is closely adjacent the surface of the ball 10. The socket 12 is then inserted within the cavity 13 of the other ball 10, to a depth such that the surfaces of the balls come into light engagement or at least very close proximity, the socket 12 being fixed in the cavity 13 by adhesive or by frictional engagement.

Figure 2:
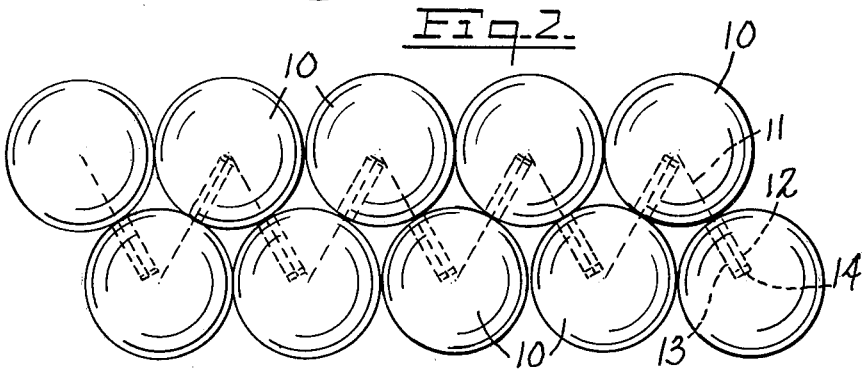
FIG. 2 illustrates a first embodiment of the present invention.

FIG. 2 shows a series of ten balls of equal radius connected as an open chain by means of the connecting devices illustrated in FIG. 1, with the angle subtended by the pin and socket of each ball being 60° in each case. Such a chain of spheres may be manipulated by rotation of spheres into various three-dimensional configurations.

Figure 3:
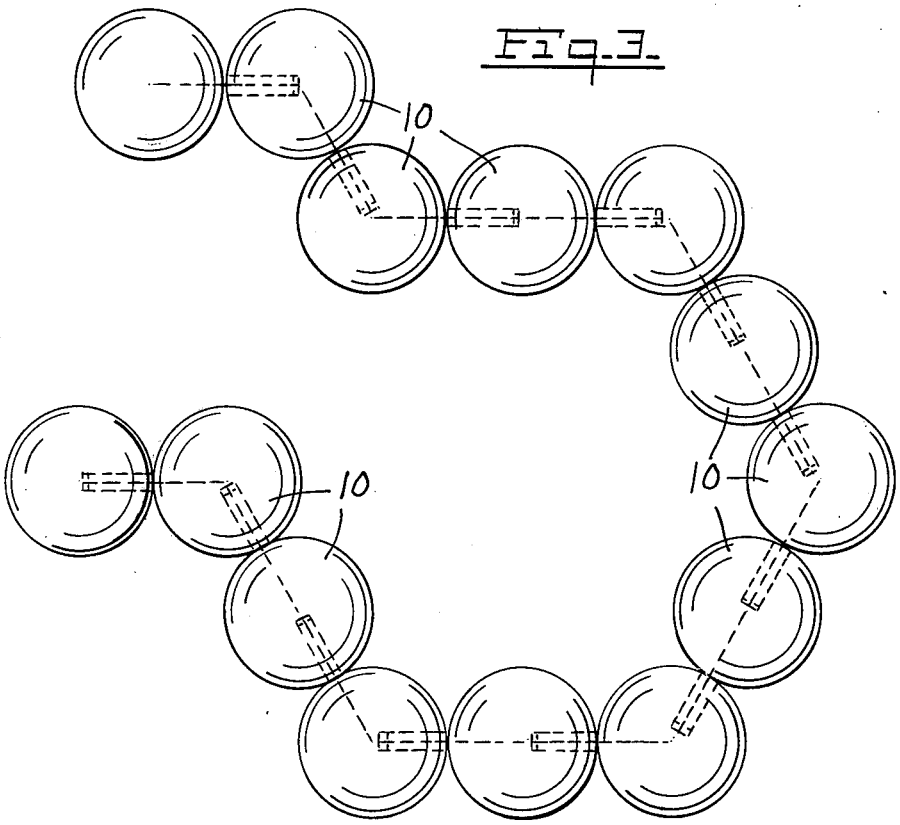
FIG. 3 illustrates a second embodiment of the present invention.

FIG. 3 shows another open chain configuration, in this instance of fourteen equal radius balls, in which the connection points subtend angles of alternately 180° and 120°.

Figure 4:
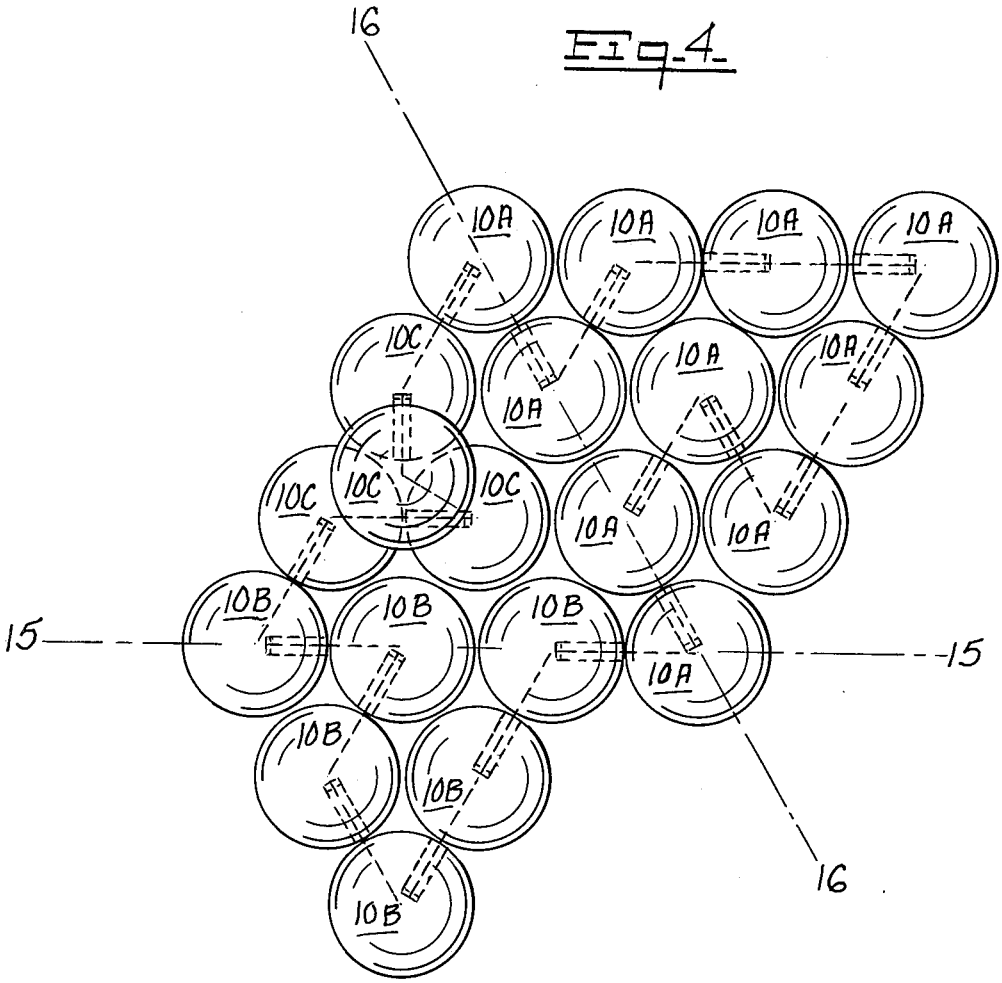
FIG. 4 illustrates a third embodiment of the present invention.
Figure 5:
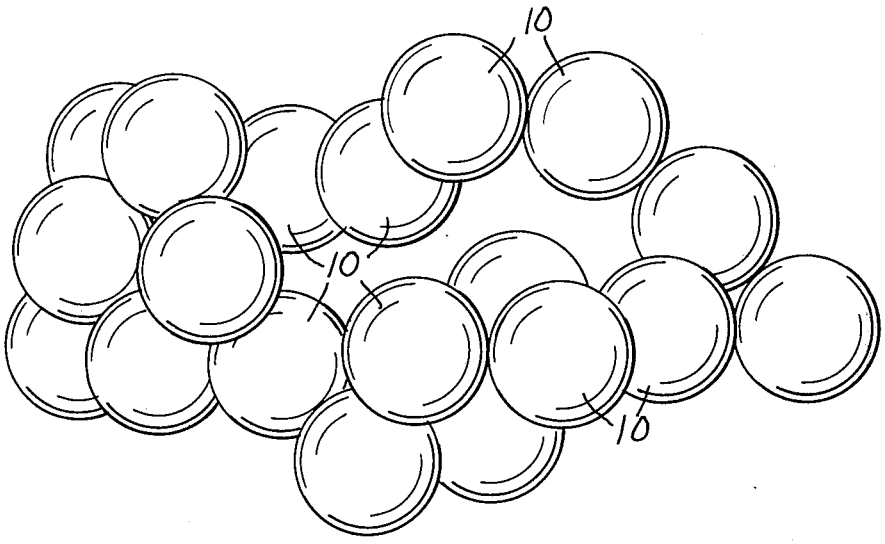
FIG. 5 illustrates a manipulated form of the embodiment of FIG. 4.
Figure 6:
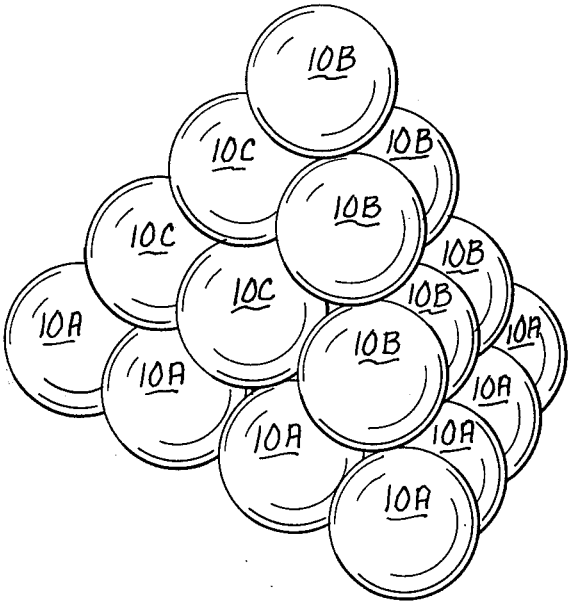
FIG. 6 illustrates a further manipulated form of the embodiment of FIG. 4.

Most interesting configurations are obtained by connecting balls in a closed loop, and such an arrangement of twenty balls is shown in FIGS. 4 to 6. Here it will be seen (FIG. 4) that the balls are interconnected with subtended angles of connection which are variously 60°, 120° or 180°, and the sequence is arranged such that the loop may be laid flat into a two-dimensional net with one ball raised, as shown in FIG. 4. Manipulation of the balls can produce a variety of irregular three-dimensional arrangements, one of which is illustrated in FIG. 5.

An examination of the arrangement shown in FIG. 4 will reveal that it consists of two triangular arrays of closest packed balls 10A and 10B, and a regular tetrahedron formed by the three balls 10C, the closest packed array of three balls of equal radius being of course tetrahedronal.

Further examination of FIG. 4 will reveal that the triangular array of balls 10B can be rotated about the connector axis 15 to form with the three-ball tetrahedron 10C a ten-ball tetrahedron, and further that if this tetrahedron is rotated about the connector axis 16 (by rotation of the balls 10A to which this ten-ball tetrahedron is connected) to rest upon the triangular array of balls 10A, a twenty-ball tetrahedron will be formed, as illustrated in FIG. 6.

Comparison of FIGS. 5 and 6 will reveal a further function of this twenty-ball array, which is a puzzle in which without foreknowledge of the simple procedure described above, a person must find a way to construct the tetrahedron starting with an arbitrary configuration of the balls.

It will be appreciated that the present invention is capable of embodiment in forms other than those described in detail above. For example, balls of differing radii, and therefore connecting angles other than multiples of 60°, may be employed, and countless variations of connecting angle sequence will enable the production of a wide variety of three-dimensional combinations. The connecting devices may be modified to enable balls to be disengaged. While the spheres of the illustrated embodiments are wooden balls, they may of course be of metal or synthetic material.

What is claimed is:

1. A manipulative toy comprising:

a plurality of spheres, each sphere being connected to two other spheres to form a closed loop, each connection between any two spheres being at a fixed point at the surface of each sphere, each such connection maintaining the connected sphere substantially in contact at the point of connection while allowing relative rotation of adjacent connected spheres about a common axis through the centers of the adjacent spheres, the sequence of the angles of intersection of the connection axes of successive spheres being chosen such that the spheres may be manipulated, by relative rotation of successive spheres into a polyhedron.

2. The manipulative toy of claim 1 wherein each sphere is of equal radius.

3. A manipulative toy of claim 1 wherein the angle subtended by two points of connection on any sphere is an integral multiple of 60°.

4. A manipulative toy as claimed in claim 1 comprising twenty spheres of which ten may be laid in a planar triangular array of closest packing, a further six may be laid in a planar triangular array of closest packing with one sphere of the said six connected to a sphere located on one side of the first-mentioned triangular array and the remaining four spheres may be manipulated into a tetrahedron two of the spheres forming the base thereof being connected respectively to a sphere of said first-mentioned triangular array and a sphere of the second-mentioned triangular array, the spheres of said second-mentioned triangular array may be packed with said remaining four spheres to form a ten-sphere tetrahedron and the spheres of said ten-sphere tetrahedron may be packed upon said first-mentioned triangular array to form a twenty-sphere tetrahedron.

* * * * *